United States Patent [19]

A'Costa

[11] Patent Number: 4,514,862

[45] Date of Patent: May 7, 1985

[54] GUN RECOIL PROTECTOR

[76] Inventor: Anthony A'Costa, 2216 7th Ave., Apt. #301, Pueblo, Colo. 81003

[21] Appl. No.: 517,102

[22] Filed: Jul. 25, 1983

[51] Int. Cl.[3] ..... A41D 13/00

[52] U.S. Cl. ..... 2/268; 2/2

[58] Field of Search ..... 2/267, 268, 2, 2.5

[56] References Cited

U.S. PATENT DOCUMENTS

| | | | |
|---|---|---|---|
| 1,526,417 | 2/1925 | Goldsmith | 2/2 |
| 2,014,991 | 9/1935 | Snyder | 2/2 |
| 2,986,738 | 6/1961 | Zubiate | 2/2 |
| 3,146,461 | 9/1964 | Kavanagh | 2/2 |
| 3,257,666 | 6/1966 | Hoffman | 2/267 X |
| 3,504,377 | 4/1970 | Biggs et al. | 2/2 |
| 3,514,786 | 6/1970 | Terwilliger | 2/2.5 |
| 4,373,211 | 2/1983 | Goudreau et al. | 2/2 |
| 4,422,183 | 12/1983 | Landi et al. | 2/2 |

*Primary Examiner*—Henry S. Jaudon
*Assistant Examiner*—J. L. Kravitz
*Attorney, Agent, or Firm*—Edwin E. Greigg

[57] ABSTRACT

A versatile recoil protector for protecting a persons shoulder during shooting of a gun. The protector is made of a main body portion which fits over the shoulder and is held in place by suitable strap means. An arm protector is secured to the main body portion in the vicinity of the shoulder thereby providing double protection at the shoulder. The protector is made of any light weight, plyable and comfortable material to which a suitable shock absorption material has been secured. A shock absorption material may be natural or synthetic rubberized material or any other suitable material.

1 Claim, 6 Drawing Figures

GUN RECOIL PROTECTOR

BACKGROUND OF THE INVENTION

This invention is directed to a device for protecting ones shoulder during firing of a gun and more particularly to a versatile recoil protector which affords good protection during firing of a gun.

Heretofore gun shooting protective devices have been formed in hunting jackets or hunting vests as padding in the area of the shoulder. Such protection devices make the jacket bulky in the protective area and make the jacket combersome.

The recoil protector of this device can be made of any material that is of light weight plyable and comfortable to the user. The device is made with padding or recoil absorption material on the inner surface of the main material so that the padding functions as a cushion. The recoil protector is a separate device which can be worn over the shirt in summer time and in the winter, the device can be worn over the shirt and under a normal winter jacket without detracting from the looks of the jacket and with comfort to the wearer.

It is therefore an object of this invention to provide a versatile recoil protector which will provide sufficient protection to allow comfort while shooting different caliber rifles, etc.

Another object is to provide a versatile recoil protector which is light wieght and not bulky so that it can be comfortably worn under an outer jacket.

Still another object is to provide a recoil protector which is easily put on and which is plyable and comfortable to the user.

Further objects and advantages will become obvious from the drawings set forth herein.

DETAILED DESCRIPTION

Figure 1:
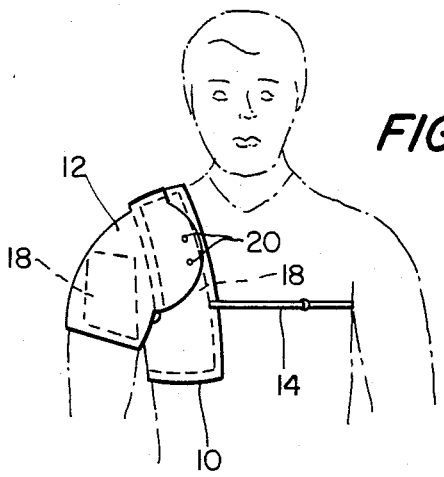
FIG. 1 illustrates a front view of the versatile recoil protector shown relative to a body on the outside of a shirt.
Figure 2:
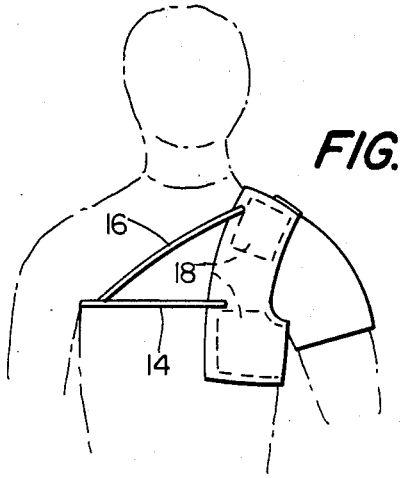
FIG. 2 illustrates a back view.

Now refering to the drawings, there is shown in FIGS. 1–4 a versatile recoil shoulder protector which is made of two main body pieces 10, 12 with two straps 14 and 16 secured to the body piece 10 which holds the shoulder protector in place relative to the body. The main body portions 10, 12 are lined with a shock absorbing material 18 such as natural or synthetically produced rubberized material. The rubberized material may adhere to the inner surface of the material over a majority of the surface area or in patches in the areas of the recoil force. FIG. 1 shows by dotted lines, the rubberized material on the front portion of the main body 10 and on the arm protector 12. FIG. 2 illustrates the rubberized material on the back inner surface shown by dotted lines on the main body portion and in FIG. 4 a portion of the rubberized coating 18 can be seen on the back portion.

As seen in FIGS. 1 and 2, the main body portion 10 fits under and over the shoulder and can be made of one single piece of material with an opening cut out for the arm. The arm protector is formed of a separate single piece of material and rivited or sewn together under the arm as seen in FIGS. 3 and 4 and rivited or sewn to the main body portion on the front side as seen in FIGS. 1 and 4.

The strap 14 secures to one edge of the main body in the front by use of a slit 22 as seen in FIG. 1 and the other end of the strap 14 secures to the edge of the main body in the back by a second slit 22. The upper strap 16 secures to one edge of the main body in the back and then is secured to the strap 14 along its length in the back in order to hold the protector in place. The straps 14 and 16 are sufficiently long and have adjusting means such as buckles or velcro so that the protector can be made to fit different sized people.

In use as a shoulder protector, the arm for the shooting shoulder is placed through the arm protector. The protector is pulled up over the arm and shoulder then the strap 14 can be secured for holding the protector in place on the body. As seen, the protector provides two layers for protection of the shoulder against a recoil impact of a shooting gun.

Figure 3:
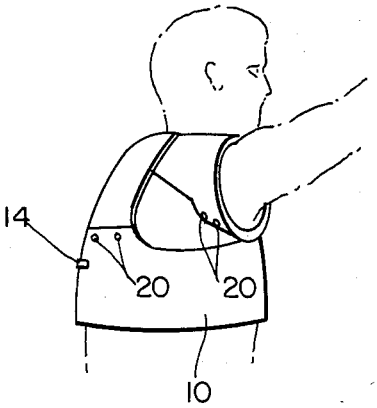
FIG. 3 illustrates a side view.
Figure 4:
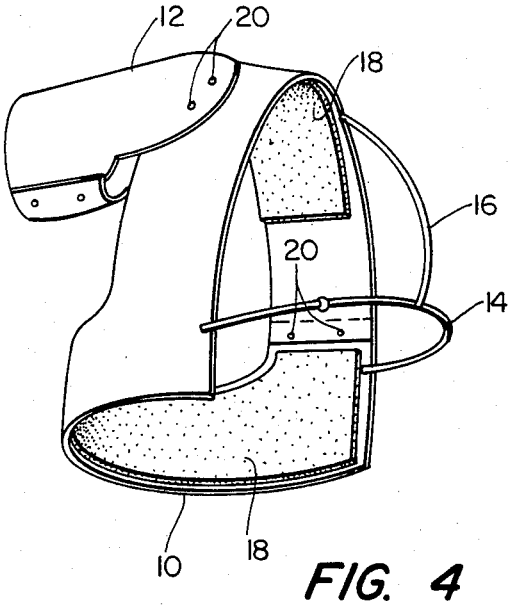
FIG. 4 illustrates a perspective view with the recoil protector rotated so that the inside can be seen looking from front to back.

FIGS. 3 and 4 illustrate a sholder protector made with a one-piece main body in which the portion that extends over the shoulder is an elongated piece that is secured to the back portion by use of rivets or sewn as shown. Thus, the opening of the main body portion through which the arm fits is formed by the end connecting to the main body portion in the back. The arm portion 12 includes a front extended portion that forms an area that overlaps a front portion of the shoulder when worn by a user. The arm portion is made and secured in the same manner as in the arrangement of FIGS. 1 and 2.

Figure 5:
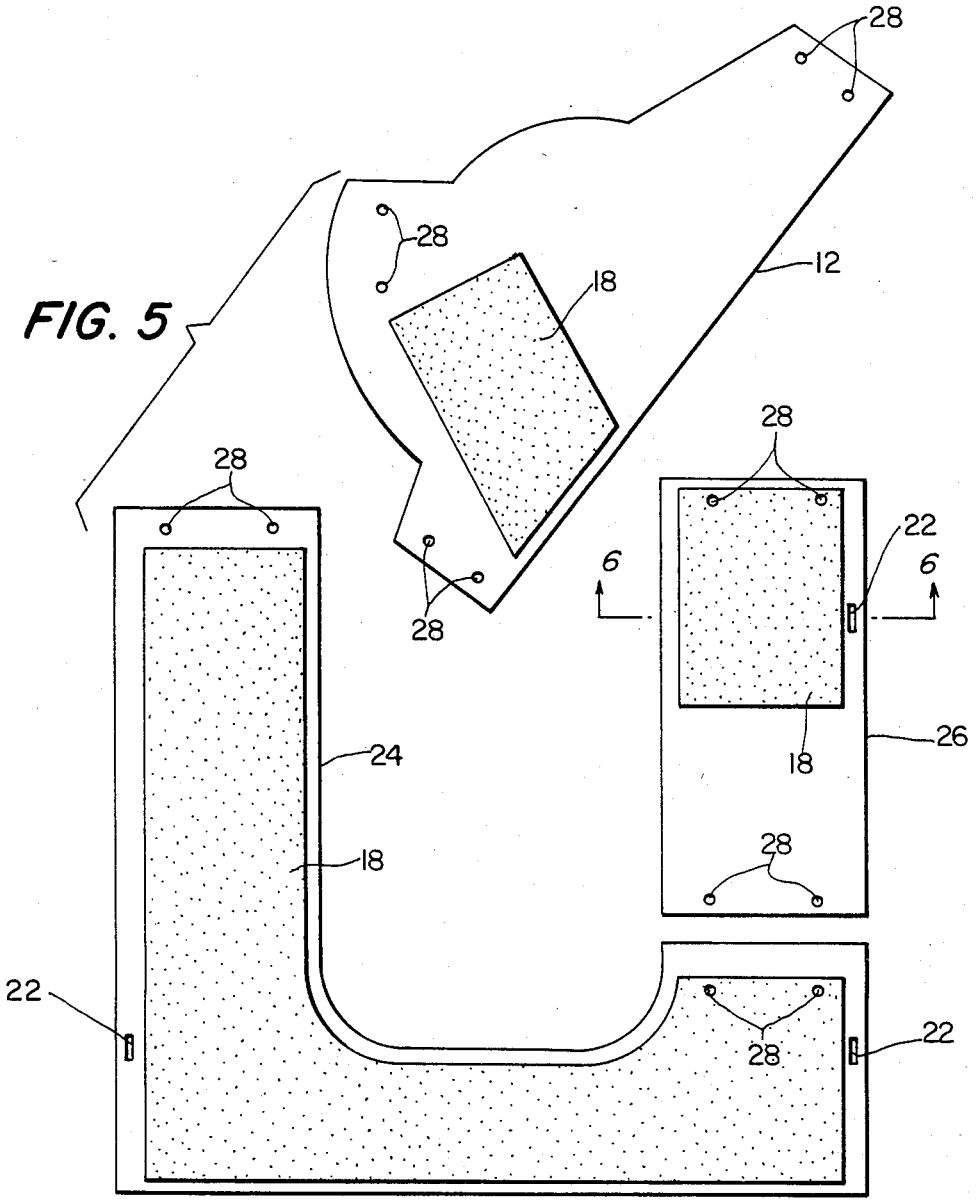
FIG. 5 illustrates a protector made of three different pieces illustrating the three different pieces.

FIG. 5 illustrates a pattern comprising three pieces from which the protector may be formed. The L-shaped portion 24 forms the front portion with a portion that extends around to the back to which the back portion 26 is secured. As seen in FIG. 5 the right hand side of the pattern would be rotated circularily toward the viewer with the panel 26 rotating toward the vertical section of the "L" and secured at the top to the upper end of panel 24 and the bottom end of panel 26 will be secured to the lower portion of panel 24. Rivet holes or by sewing 28 have been shown in each of panels through which rivets or sewing may pass to secure the ends together.

Figure 6:
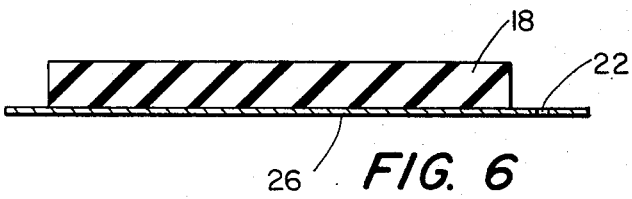
FIG. 6 illustrates a cross-sectional view along lines 6—6 of FIG. 5 through one piece illustrating the padding adhering to the main material of the recoil protector.

The arm protector shown in FIG. 5 is the same as shown in the other views. FIG. 6 illustrates a cross-sectional view through the main body material and the rubberized material. This section illustrates the relationship of the force absorbing material 18 to that of the main material. The straps 14 and 16 are not shown in FIG. 5 but will connect to the main body portions 24 and 26 through slits 22 such as shown in FIGS. 1, 2 and 4.

A shoulder protector for absorbing recoils of guns may be worn on the outside of a shirt and under a jacket in the winter with comfort and without interference in wearing of the jacket. The protector is light weight and may be made of any desired material which is suitble for the main body and for the recoil absorbtion material.

The protector is easy to put on by slipping the arm through the arm protector and pulling the main body up over the shoulders. The long strap is then "circled" the body and secured to the slit in front panel of the protector. The protector may be made in the same manner by reversal of parts for the left shoulder.

The protector has been described as secured together by rivets or by being sewn. Any device by which materials may be secured together may be used without departing from the intent of the invention. Rivets come in many varities, any of which may be used, if suitable or may be machine sewn.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A versatile recoil protector for a user's shoulder during firing a gun, which comprises:

a main body protector portion, said main body protector portion having an inner surface and an outer surface, said inner surface having a padded area of absorption material, said main body protector portion having a horizontal leg portion and a vertical portion, said horizontal portion arranged to extend across a portion of the torso of the wearer from front-to-back under the arm and the vertical portion of said protector is arranged to pass up to and above the shoulder of the wearer, a rectangularly shaped panel arranged to be secured to said horizontal portion of said protector and to said vertical portion along the back side of the wearer above the shoulder, a tubular portion capable of encircling the arm of the wearer and including a front extended portion that overlaps and is affixed to said vertical portion, said tubular portion further being delimited adjacent to the bicep of the wearer and means for securing said recoil protector relative to the shoulder of the wearer.

* * * * *